US006687469B2

(12) United States Patent
Takane

(10) Patent No.: US 6,687,469 B2
(45) Date of Patent: Feb. 3, 2004

(54) IMAGE FORMING APPARATUS HAVING AN END OFFSET AVOIDING MODE BASED ON SHEET SIZE

(75) Inventor: Ryouta Takane, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/320,389

(22) Filed: Dec. 17, 2002

(65) Prior Publication Data

US 2003/0113127 A1 Jun. 19, 2003

(30) Foreign Application Priority Data

Dec. 19, 2001 (JP) ..... 2001-386167

(51) Int. Cl.[7] ..... G03G 15/20
(52) U.S. Cl. ..... 399/45; 399/69
(58) Field of Search ..... 399/33, 45, 67, 399/68, 69, 70

(56) References Cited

U.S. PATENT DOCUMENTS 5,363,173 A * 11/1994 Alesio et al.
5,680,651 A * 10/1997 Tsuji et al.
6,115,563 A * 9/2000 Miyamoto ..... 399/67
6,151,462 A * 11/2000 Fukuzawa et al. ..... 399/67
6,314,252 B1 * 11/2001 Matsumoto ..... 399/45
2002/0136564 A1 * 9/2002 Takamine et al.

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image formation controlling device controls, on the basis of the width of a recording sheet on which previous image formation has been effected and a detected temperature at the longitudinal end portions of the heater, the heat fixing operation in the next image forming operation, and having an end offset avoiding mode for inhibiting the image forming operation until the detected temperature drops below a preset reference temperature when the width of a recording sheet used in the next image forming operation is broader than the width of the recording sheet on which the previous image formation has been effected and the detected temperature is higher than the reference temperature. Also provided is a performance priority mode for executing the image forming operation without inhibiting the image forming operation during the end offset avoiding mode thereof and the end offset avoiding mode selectively changeable over.

4 Claims, 5 Drawing Sheets

IMAGE FORMING APPARATUS HAVING AN END OFFSET AVOIDING MODE BASED ON SHEET SIZE

BACKGROUND OF THE INVENTION

1. Field of the Invention

The invention relates to an image forming apparatus provided with image formation controlling means for controlling a heat fixing operation for an unfixed toner image.

2. Description of Related Art

Generally, in various image forming apparatuses such as an electrophotographic copying machine and a printer, design is made such that a toner image obtained by developing is transferred onto and borne on a recording sheet, and the unfixed toner image is heated and fused by a fixing device and is fixed thereby. This fixing device, as shown, for example, in FIG. 4 of the accompanying drawings, has a fixing roller 1 as a heater disposed in a sheet transport path for a recording sheet, and a pressure roller 2 brought into pressure contact with the fixing roller 1, and when a recording sheet having an unfixed toner image thereon is passed to a nip portion which is the pressure contact portion between these two rollers 1 and 2, heating means 3 comprising a halogen heater or the like disposed in the fixing roller 1 is electrically energized, whereby the whole of the fixing roller 1 is raised in temperature, and the unfixed toner image on the recording sheet is heated and fused by the heat from the fixing roller 1, whereafter the toner image is fixed on the recording sheet.

Also, in order to improve the durability and productivity of pressure means comprising the above-described pressure roller 2, there has also been proposed a fixing device using as the pressure means a pressure belt 4 comprising a thin film-like member as shown in FIG. 5 of the accompanying drawings. This pressure belt 4 comprising a thin film-like member is brought into pressure contact with the outer peripheral surface of the fixing roller 1, and is raised in temperature by the heating means 3 disposed in the pressure contact portion being electrically energized, whereby a heat fixing operation for the unfixed toner image is likewise performed.

However, as recording sheets used in the image forming apparatus, use is made of recording sheets of various sizes from a small width size like a postcard size to a large width size such as A4-size or A3-size, and in an image forming apparatus designed to be capable of using recording sheets of those various width sizes, the above-described fixing device suffers from the following problems.

When for example, a plurality of recording sheets of a small width size like a postcard size are continuously passed to the fixing roller 1 constituting the heater of the above-described fixing device, the temperature distribution of the nip portion of the fixing roller 1 after the continuous passing of the recording sheets becomes such as shown, for example, in FIG. 6 of the accompanying drawings. That is, in the widthwisely central area in which the passing of the recording sheets of a small width size is effected, heat is taken by the passed recording sheet size, whereby the surface temperature of the fixing roller 1 in the aforementioned central area is considerably decreased. In contrast, the surface temperature of the fixing roller 1 in the widthwisely opposite end areas remains maintained at a high temperature because the passing of recording sheets is not effected there.

When with the temperature distribution of the fixing roller 1 remaining so non-uniform in the widthwise direction, a recording sheet of a large width size such as a recording sheet of A3-size or a non-fixed size is immediately passed to the fixing roller 1, the widthwisely opposite end areas which has been in a high temperature state become further overheated, and the unfixed toner image on such recording sheet is excessively fused and a so-called offset phenomenon occurs and may sometimes result in a bad image. To avoid such an offset phenomenon, when the width size of the recording sheet has been changed to a large one, an end offset avoiding mode for starting the image forming operation can be set after the surface temperature of the fixing roller 1 is decreased to a reference temperature or lower, but depending on users, there is a case where it is desired to give priority to the speed of image formation rather than to the quality of image, and it sometimes spoil operability to set the end offset avoiding mode.

SUMMARY OF THE INVENTION

So, the present invention has as its object to provide an image forming apparatus designed such that an offset phenomenon, which may occur when the width size of a recording sheet is changed, can be prevented well without spoiling a user's operability.

In order to achieve the above object, in an image forming apparatus provided with an unfixed image forming portion for causing an unfixed toner image corresponding to an image to be borne on a recording sheet, a fixing device provided with a heater for performing a heat fixing operation to the unfixed toner image to thereby fix the toner image on the recording sheet, and image formation controlling means for controlling, on the basis of the width size of the recording sheet on which the previous image formation has been effected, and the detected temperature in the longitudinal end portion of the heater, the heat fixing operation in the next image forming operation, the image formation controlling means is provided with the end offset avoiding mode function of inhibiting the image forming operation until the detected temperature of the end portion of the heater becomes below a preset reference temperature when the width size of a recording sheet used in the next image forming operation is broader than the width size of the recording sheet on which the previous image formation has been effected and the detected temperature of the end portion of the heater is higher than the reference temperature.

Also, the image formation controlling means is provided with the function of making a performance priority mode for executing the image forming operation without inhibiting the image forming operation during the end offset avoiding mode and the end offset avoiding mode selectively changeable over.

According to such an image forming apparatus, when the width size of a recording sheet has been changed, the end offset avoiding mode is suitably executed by the image formation controlling means, whereby the so-called offset phenomenon is prevented well.

Also, depending on a user's liking, by the performance priority mode being set, it becomes possible to give priority to the image forming operation.

Also, the image formation controlling means is provided with the function of changing over and setting one of the end offset avoiding mode and the performance priority mode in default, and also the function of effecting image formation in other mode than the mode set in default, and thereafter returning it to the mode set in default and therefore, it becomes possible to secure good usability conforming to the user's liking.

Further, the image formation controlling means has the function of executing the end offset avoiding mode when a recording sheet used previously or used next time is a sheet of a non-fixed size and the detected temperature of the end portion of the heater is higher than the reference temperature. According to such an image forming apparatus, the so-called offset phenomenon when a sheet of a non-fixed size is used is prevented well and depending on the user's liking, image formation giving priority to the speed of image formation becomes possible.

DESCRIPTION OF THE PREFERRED EMBODIMENTS

Before some embodiments of the present invention will hereinafter be described in detail with reference to the drawings, the structure of an image forming apparatus will be schematically described with a laser printer taken as an example thereof.

Figure 1:
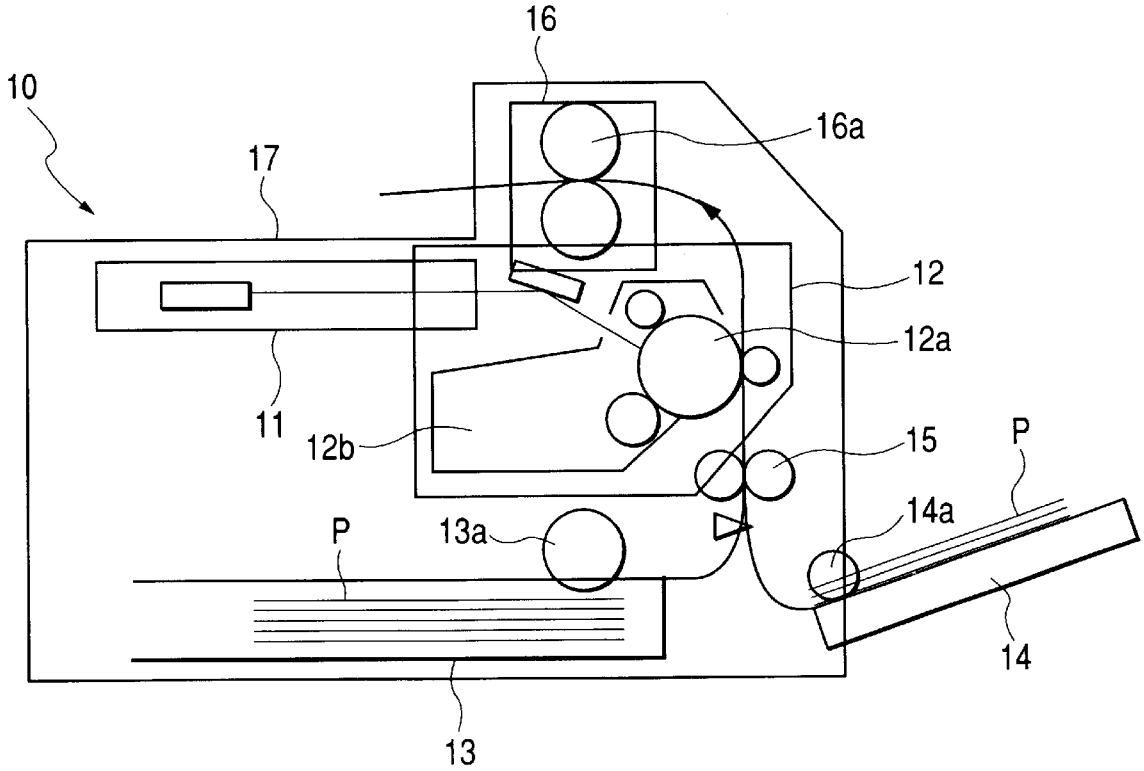
FIG. 1 is a vertical cross-sectional illustration showing an example of the construction of a laser printer as an example of an image forming apparatus to which the present invention is applied.

In a laser printer 10 shown in FIG. 1, image information sent to the printer 10 from the outside of the printer 10 is imaged as light-modulated information on the photosensitive drum 12*a* of an unfixed image forming portion 12 by a writing-in optical portion 11, and the light spot thereof is reciprocally scanned in the axial direction of the photosensitive drum 12*a*, whereby an electrostatic latent image corresponding to the formed image is formed on the photosensitive drum 12*a*. A toner is supplied from a developing device 12*b* to the electrostatic latent image on the photosensitive drum 12*a*, whereby an unfixed toner image is formed thereon. On the other hand, in the lower portion of the image forming apparatus, there are disposed recording sheets P stored in a feed cassette 13 or a feed tray 14, and design is made such that the recording sheets P in the feed cassette 13 or the feed tray 14 are drawn out by a feed roller 13*a* or 14*a*, and are fed to the transferring portion of the above-described photosensitive drum 12*a* in timed relationship by registration rollers 15.

Figure 4:
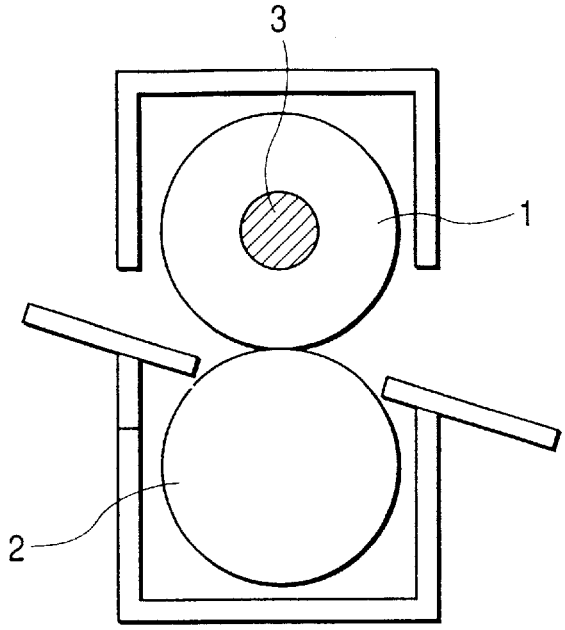
FIG. 4 PRIOR ART
FIG. 4 is a vertical cross-sectional illustration showing an example of a fixing device.
Figure 5:
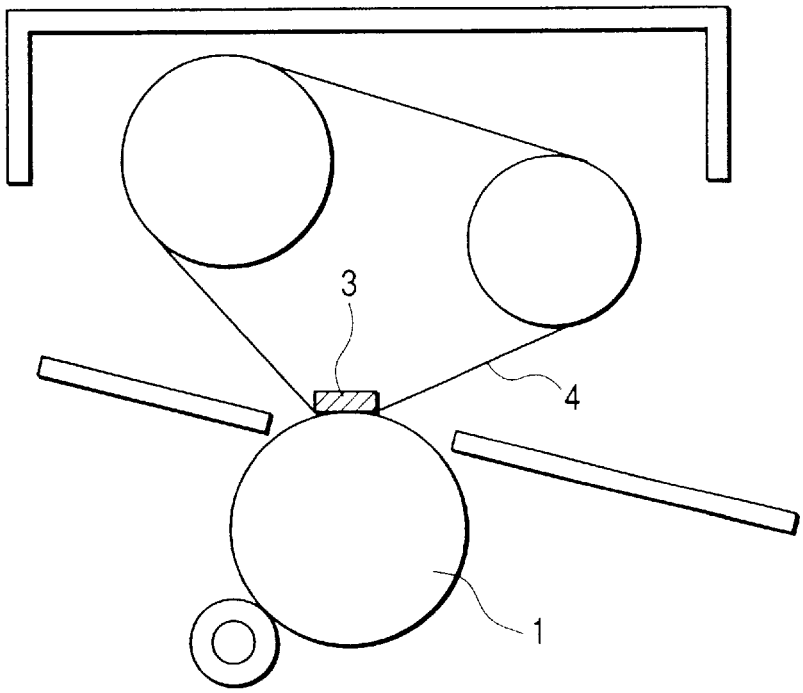
FIG. 5 PRIOR ART
FIG. 5 is a vertical cross-sectional illustration showing another example of the fixing device.

In the transferring portion, the unfixed toner image on the photosensitive drum 12*a* is transferred onto the recording sheet P, and the recording sheet P now bearing the unfixed toner thereon is transported toward a fixing device 16. The fixing device 16 is provided with a fixing roller 16*a* as the aforedescribed heater as shown in FIG. 4 or 5, and the unfixed toner on the recording sheet P is heated and fused by the heat fixing operation of the fixing roller 16*a* and as the result, the toner image is fixed on the recording sheet P. The recording sheet P on which the toner image has been fixed by such a heat fixing operation is delivered onto a delivery tray 17 in the upper portion of the image forming apparatus.

Figure 6:
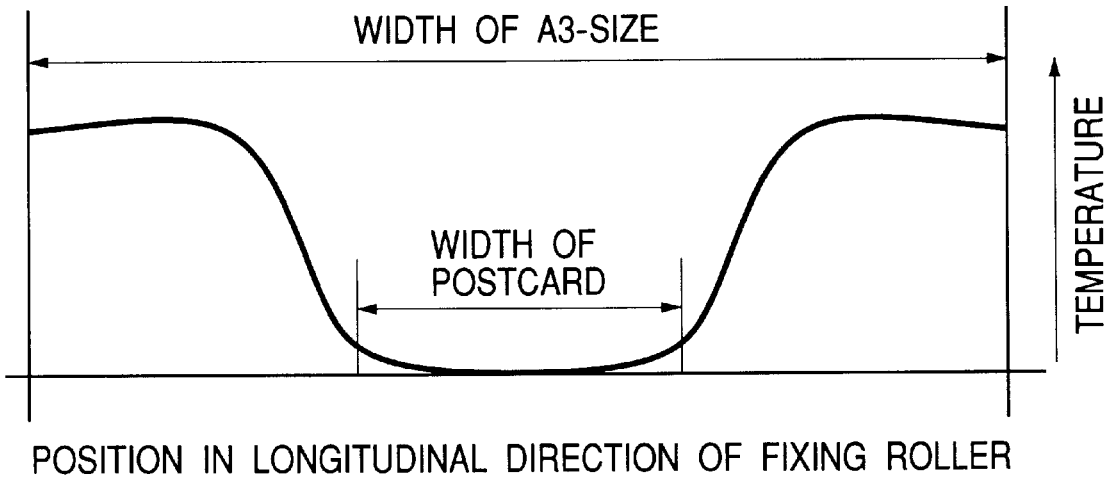
FIG. 6 is a graph showing a widthwise temperature distribution after recording sheets of a small width size have been continuously passed to a fixing roller.

At this time, the heat fixing operation in the above-described fixing device 16 is controlled by image formation controlling means (not shown) provided in the interior of the image forming apparatus. That is, the image formation controlling means receives the distribution of surface temperature in the longitudinal direction of the fixing roller 16*a* (see FIG. 6) detected by a temperature sensor such as a thermistor (not shown), and has the function of controlling the heat fixing operation in the next image forming operation on the basis of the detected temperature in the longitudinal end portions of the fixing roller 16*a* and the width size of the recording sheet P used in the previous image formation, as follows.

Figure 2:
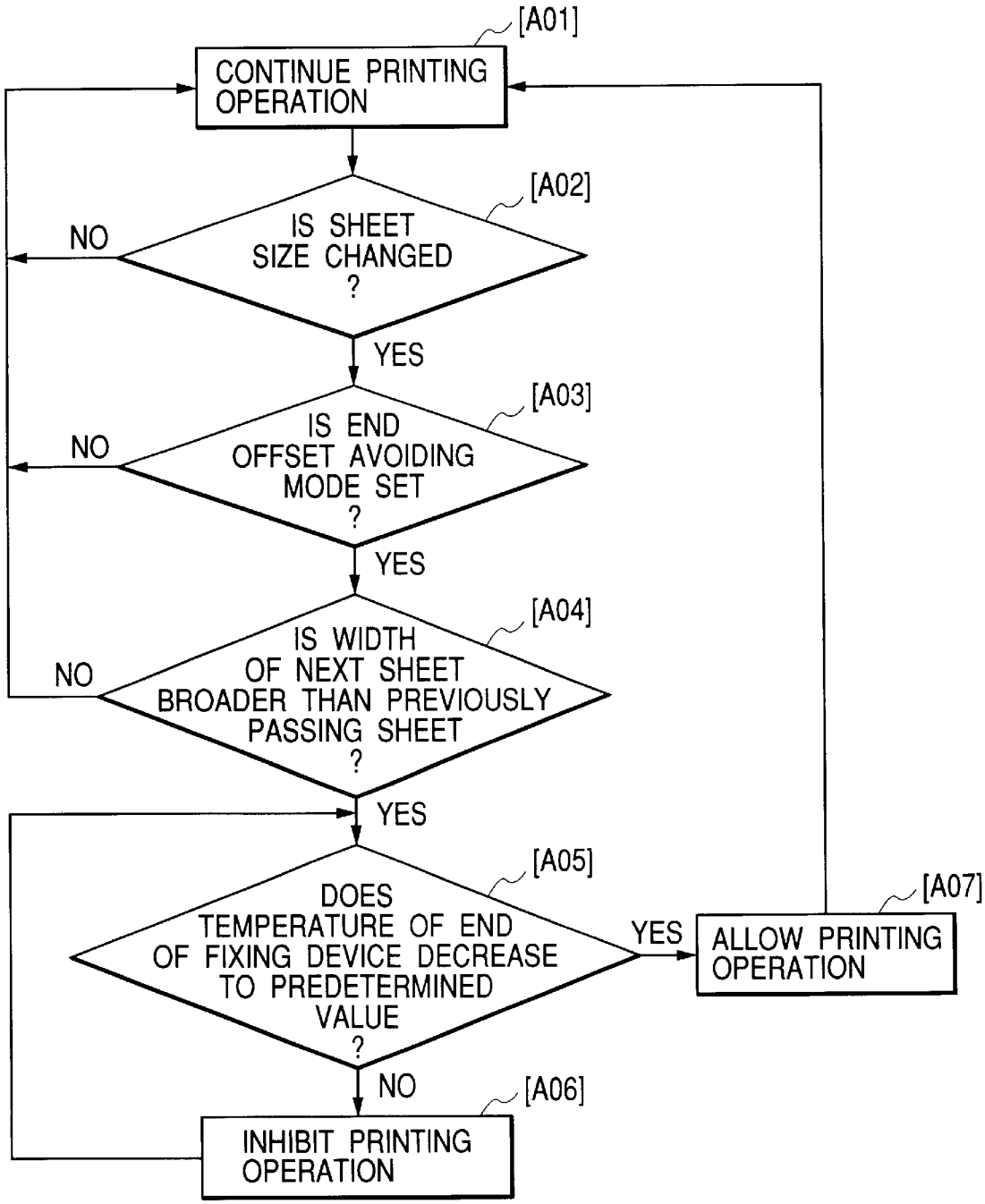
FIG. 2 is a flowchart showing an embodiment of the control procedure by the image formation controlling means of the present invention.

That is, as shown, for example, in FIG. 2, when the laser printer 10 as the image forming apparatus is continuing the printing operation (step A01), if a command for changing the width size of the recording sheet P is generated (Yes at step A02), at that point of time, whether an end offset avoiding mode for inhibiting the printing operation as will be described later is set is checked up (step A03). If as a result of the check-up, a performance priority mode for continuing the printing operation is set or selected in default, whereby the end offset avoiding mode is not selected (No at step A03), the printing operation is intactly continued (step A01). As described above, the performance priority mode can be arbitrarily set in default or at desired timing in accordance with a user's liking, and design is made such that when the performance priority mode is set, the end offset avoiding mode is not executed, but the printing operation is continued.

On the other hand, if at a point of time whereat the command for changing the width size of the recording sheet P has been generated (Yes at step A02), the end offset avoiding mode is set or selected in default, whereby the end offset avoiding mode is brought about (Yes at step A03), the width size of the recording sheet P passed in the previous job and the width size of a recording sheet P to be passed next time are compared with each other (step A04).

If the width size of the recording sheet P to be passed next time is not broader than the width size of the previously passed recording sheet P but is the same as or narrower than the latter (No at step A04), it is judged that the offset phenomenon will not occur, and the printing operation is intactly continued (step A01). On the other hand, if the width size of the recording sheet P to be passed next time is broader than the width size of the previously passed recording sheet P (Yes at step A04), it is judged that the offset phenomenon may occur, and the printing operation is rendered into a waiting state and yet the end offset avoiding mode is executed.

That is, in this end offset avoiding mode, the detected temperature of the end portions of the fixing roller 16*a* of the fixing device 16 is first checked up (step A05), and as long as it does not decrease to a predetermined reference temperature or lower (No at step A05), the printing operation is inhibited (Yes at step A04) so as not to cause the offset phenomenon. When the detected temperature of the end portions of the fixing roller 16*a* has decreased to the reference temperature or lower which does not cause the offset phenomenon (Yes at step A05), the printing operation is allowed (step A07), and the printing operation is continued again (step A01).

As described above, according to the laser printer according to the present embodiment, when the width size of the recording sheet P has been changed, the end offset avoiding mode is suitably executed by the image formation controlling means, whereby the so-called offset phenomenon is prevented well and depending on the user's liking, the performance priority mode is set, whereby image formation giving priority to the printing operation becomes possible.

Also, in the above-described embodiment, the image formation controlling means has the function of changing over and setting one of the end offset avoiding mode for inhibiting the printing operation and the performance priority mode in default, and also has the function of returning the mode to the mode set in default after the printing operation has been performed in other mode than the mode set in default. Accordingly, according to the present embodiment, it is possible to secure good usability conforming to the user's liking.

Figure 3:
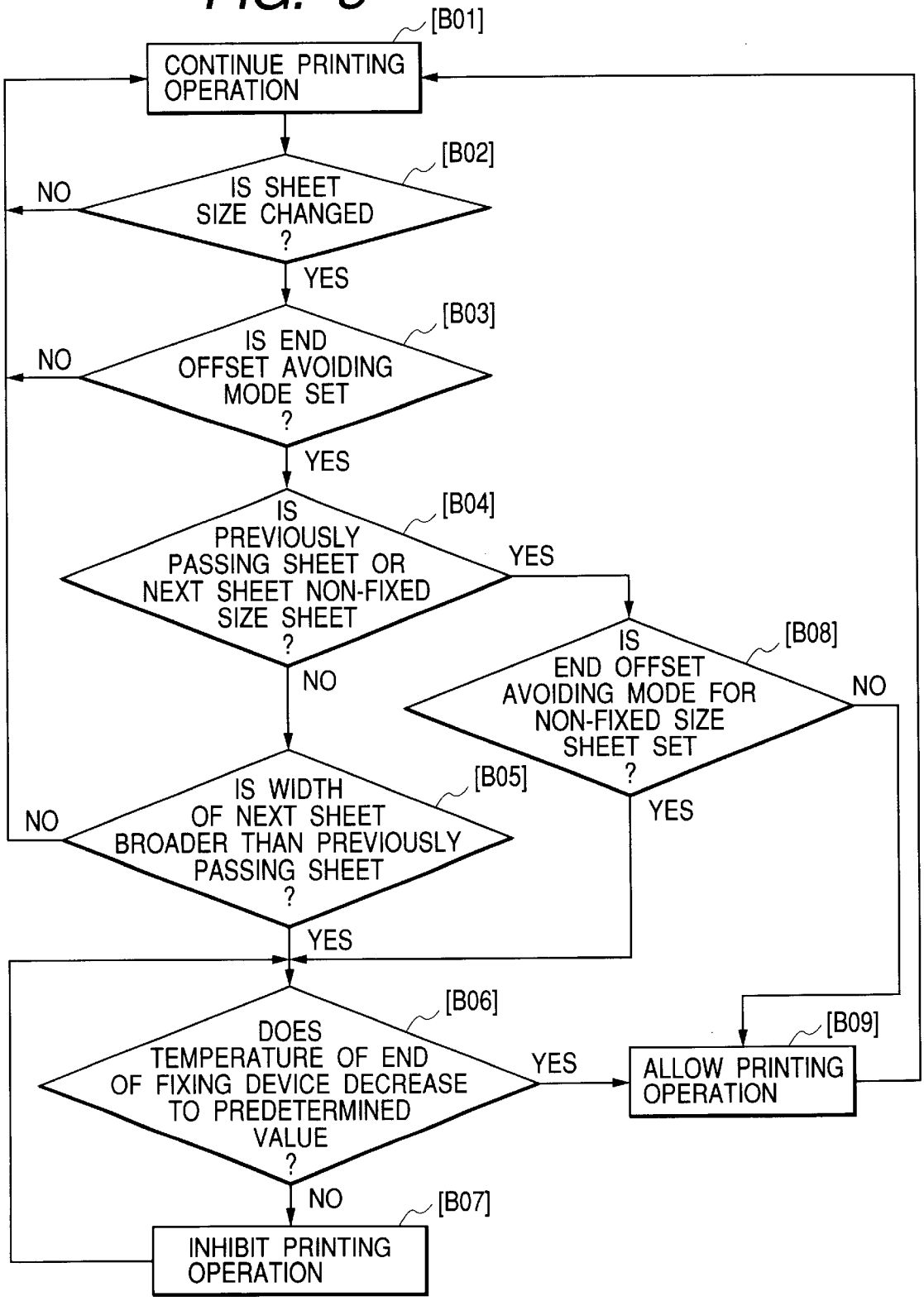
FIG. 3 is a flowchart showing another embodiment of the control procedure by the image formation controlling means of the present invention.

Also, in the embodiment shown in FIG. 3, design is made such that when the recording sheet P previously passed or the recording sheet P to be passed next time is a sheet of a non-fixed size, the end offset avoiding mode is executed.

That is, as shown in FIG. 3, when the laser printer as the image forming apparatus is continuing the printing operation (step B01), if a command for changing the width size of the recording sheet P is generated (Yes at step B02), at that point of time, whether the end offset avoiding mode for inhibiting the printing operation is set is checked up (step B03). If as a result of the check up, the performance priority mode for continuing the printing operation is set or selected in default, whereby the end offset avoiding mode is not selected (No at step B03), the printing operation is intactly continued (step B01). On the other hand, if the end offset avoiding mode is set or selected in default, whereby the end offset avoiding mode is brought about (Yes at step B03), whether the recording sheet P passed in the previous job or the recording sheet P to be passed next time is a sheet of a non-fixed size is checked up (step B04).

If as a result of the check-up, the recording sheet P passed in the previous job or the recording sheet P to be passed next time is not a sheet of a non-fixed size, but a sheet of a fixed size (No at step B04), as in the above-described embodiment, the width size of the recording sheet P passed in the previous job and the width size of the recording sheet P to be passed next time are compared with each other (step B05). If the width size of the recording sheet P to be passed next time is not broader than the width size of the recording sheet P passed previously (No at step B05), it is judged that the offset phenomenon will not occur, and the printing operation is intactly continued (step B01). On the other hand, if the width size of the recording sheet P to be passed next time is broader than the width size of the sheet passed previously (Yes at step B05), it is judged that the offset phenomenon may occur, and the printing operation is rendered into a waiting state, and yet the temperature of the end portions of the fixing roller 16*a* of the fixing device 16 is detected (step B06), and as long as the detected temperature of the end portions of the fixing roller 16*a* does not decrease to the reference temperature which does not cause the offset phenomenon (No at step B06), the printing operation is inhibited (step B07). When the detected temperature of the end portions of the fixing roller 16*a* decreases to the reference temperature, which does not cause the offset phenomenon (Yes at step B06), the printing operation is allowed (step B09), and the printing operation is continued again (step B01).

Also, if as described above, whether the recording sheet P passed in the previous job or the recording sheet P to be passed next time is a sheet of a non-fixed size is checked up (step B04) and as the result, the recording sheet P passed in the previous job or the recording sheet P to be passed next time is a sheet of a non-fixed size (Yes at step B04), whether the mode is set so as to shift to the offset mode in the case of a sheet of a non-fixed size is checked up (step B08).

If as a result of the check-up, the end offset mode is not set for the sheet of a non-fixed size (No at step B08), the printing operation is allowed (step B09), and the printing operation is continued again (step B01) On the other hand, if the end offset mode is set for the sheet of a non-fixed size (Yes at step B08), the printing operation is rendered into a waiting state, and yet the temperature of the end portions of the fixing roller 16*a* of the fixing device 16 is detected (step B06), and as long as the detected temperature of the end portions of the fixing roller 16*a* does not decrease to the reference temperature which does not cause offset (No at step B06), the printing operation is inhibited (step B07). When the detected temperature of the end portions of the fixing roller 16*a* decreases to the reference temperature, which does not cause offset (Yes at step B06), the printing operation is allowed (step B09), and the printing operation is continued again (step B01).

According to the laser printer according to such an embodiment, when the recording sheet P used has been changed to a sheet of a non-fixed size, the so-called offset is prevented well by the image formation controlling means and also, depending on the user's liking, image formation giving priority to the printing operation becomes possible.

While the invention made by the inventor has been specifically described with respect to some embodiments thereof, the present invention is not restricted to the above-described embodiments, but of course can be variously modified without departing from the gist of the invention.

For example, the present invention can be equally applied to a variety of other image forming apparatuses than the laser printers according to the above-described embodiments.

What is claimed is:

1. An image forming apparatus comprising:

an unfixed image forming portion for causing an unfixed toner image corresponding to an image to be borne on a recording sheet;

a fixing device provided with a heater for performing a heat fixing operation to the unfixed toner image to thereby fix the toner image on the recording sheet; and image formation controlling means for controlling, on the basis of a width size of a recording sheet on which a previous image formation has been effected and a detected temperature at a longitudinal end portion of the heater, a heat fixing operation in a next image forming operation, wherein the image formation controlling means has an end offset avoiding mode for inhibiting the image forming operation until the detected temperature of the end portion becomes below a preset reference temperature when the width size of a recording sheet used in the next image forming operation is broader than the width size of the recording sheet on which the previous image formation has been effected and when the detected temperature of the end portion of the heater is higher than the reference temperature, wherein the image formation controlling means has a function of enabling a selective changing-over between a performance priority mode for executing the image forming operation without inhibiting the image forming operation and the end offset avoiding mode.

2. An image forming apparatus according to claim 1, wherein the image formation controlling means has a function of changing over and setting one of the end offset avoiding mode and the performance priority mode in default, and also has a function of returning, after an image formation has been effected in the other mode than the mode set in default, from the other mode to the mode set in default again.

3. An image forming apparatus according to claim 1, wherein the image formation controlling means has a function of executing the end offset avoiding mode when a previously used recording sheet or a recording sheet to be used next time is a sheet of a non-fixed size and when the detected temperature of the end portion of the heater is higher than the reference temperature.

4. An image forming apparatus according to claim 2, wherein the image formation controlling means has a function of executing the end offset avoiding mode when a previously used recording sheet or a recording sheet to be used next time is a sheet of a non-fixed size and when the detected temperature of the end portion of the heater is higher than the reference temperature.

* * * * *

UNITED STATES PATENT AND TRADEMARK OFFICE

CERTIFICATE OF CORRECTION

PATENT NO. : 6,687,469 B2
DATED : February 3, 2004
INVENTOR(S) : Ryouta Takane

It is certified that error appears in the above-identified patent and that said Letters Patent is hereby corrected as shown below:

Column 2,
Line 4, “has” should read -- have --.
Line 15, “spoil” should read -- spoils --.

Column 6,
Line 9, “(step B01)” should read -- step B01). --.

Signed and Sealed this

First Day of June, 2004

JON W. DUDAS
*Acting Director of the United States Patent and Trademark Office*